US009885513B2

(12) United States Patent
Litch

(10) Patent No.: US 9,885,513 B2
(45) **Date of Patent: *Feb. 6, 2018**

(54) SPECIALTY COOLING FEATURES USING EXTRUDED EVAPORATOR

(71) Applicant: Whirlpool Corporation, Benton Harbor, MI (US)

(72) Inventor: Andrew D. Litch, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 334 days.

This patent is subject to a terminal disclaimer.

(21) Appl. No.: 14/682,380

(22) Filed: Apr. 9, 2015

(65) Prior Publication Data

US 2015/0211780 A1 Jul. 30, 2015

Related U.S. Application Data

(63) Continuation of application No. 13/833,957, filed on Mar. 15, 2013, now Pat. No. 9,046,287.

(51) Int. Cl.
*F25D 21/12* (2006.01)
*F25D 11/02* (2006.01)
(Continued)

(52) U.S. Cl.
CPC ..... *F25D 21/12* (2013.01); *F25B 1/00* (2013.01); *F25B 39/02* (2013.01); *F25D 11/006* (2013.01);
(Continued)

(58) Field of Classification Search
None
See application file for complete search history.

(56) References Cited

U.S. PATENT DOCUMENTS 2,063,616 A 12/1936 Spencer
2,188,349 A 1/1940 Frederick
(Continued)

FOREIGN PATENT DOCUMENTS

CN 2709888 Y 7/2005
CN 101963438 A 2/2011
(Continued)

*Primary Examiner* — Mohammad M Ali
(74) *Attorney, Agent, or Firm* — Price Heneveld LLP

(57) ABSTRACT

An appliance includes a co-extruded evaporator in thermal communication with a compartment. The co-extruded evaporator includes main and support channels in thermal communication that share a common wall. A main cooling loop is in fluid communication with the main channel. A plurality of co-extruded fins are disposed proximate and in thermal communication with the main and support channels. A coolant is disposed in the main channel and the main cooling loop. A thermally conductive media is selectively disposed in the support channel in fluid and thermal communication with the main channel. The thermally conductive media is chosen from the group consisting of a support channel coolant, wherein the appliance includes a second cooling loop in fluid communication with the support channel, a thermal storage material in thermal communication with the compartment, and a defrost fluid, wherein the appliance includes a defrost circuit in fluid communication with the support channel.

20 Claims, 8 Drawing Sheets

(51) Int. Cl.

| | |
|---|---|
| ***F25B 39/02*** | (2006.01) |
| ***F25B 1/00*** | (2006.01) |
| ***F28F 17/00*** | (2006.01) |
| ***F28D 1/047*** | (2006.01) |
| ***F28D 7/00*** | (2006.01) |
| ***F28F 1/02*** | (2006.01) |
| ***F28F 1/16*** | (2006.01) |
| ***F28F 1/26*** | (2006.01) |
| ***F25D 11/00*** | (2006.01) |
| *F25B 25/00* | (2006.01) |
| *F28D 20/00* | (2006.01) |

(52) U.S. Cl.

CPC ..... *F25D 11/02* (2013.01); *F28D 1/0477* (2013.01); *F28D 1/0478* (2013.01); *F28D 7/0016* (2013.01); *F28D 7/0041* (2013.01); *F28F 1/022* (2013.01); *F28F 1/16* (2013.01); *F28F 1/26* (2013.01); *F28F 17/00* (2013.01); *F25B 25/005* (2013.01); *F25B 2400/24* (2013.01); *F28D 2020/0013* (2013.01)

(56) References Cited

U.S. PATENT DOCUMENTS

| | | | | |
|---|---|---|---|---|
| 2,405,432 | A | 8/1946 | Kleist | |
| 2,515,825 | A | 7/1950 | Adams | |
| 3,866,439 | A * | 2/1975 | Bussjager | F25B 39/02 62/504 |
| 3,875,759 | A * | 4/1975 | Malcosky | F25B 39/02 165/156 |
| 4,114,396 | A | 9/1978 | Rickert | |
| 4,951,481 | A | 8/1990 | Negishi | |
| 5,214,938 | A * | 6/1993 | Kennedy | F25B 39/02 165/146 |
| 5,341,870 | A | 8/1994 | Hughes et al. | |
| 5,533,259 | A | 7/1996 | Hughes et al. | |
| 5,622,219 | A | 4/1997 | Voss et al. | |
| 5,901,782 | A | 5/1999 | Voss et al. | |
| 6,185,957 | B1 | 2/2001 | Voss et al. | |
| 6,467,536 | B1 | 10/2002 | Abate et al. | |
| 6,539,746 | B1 | 4/2003 | Haussmann | |
| 6,581,679 | B2 | 6/2003 | Fischer et al. | |
| 7,066,243 | B2 | 6/2006 | Horiuchi | |
| 7,418,999 | B2 | 9/2008 | Takano | |
| 2002/0066553 | A1 | 6/2002 | Fischer et al. | |
| 2002/0179291 | A1 | 12/2002 | Abate et al. | |
| 2003/0066633 | A1 | 4/2003 | Lee et al. | |
| 2003/0070752 | A1 | 4/2003 | Bergevin et al. | |
| 2004/0159121 | A1 | 8/2004 | Horiuchi et al. | |
| 2006/0032623 | A1 * | 2/2006 | Tsubone | B60H 1/00492 165/202 |
| 2006/0130517 | A1 | 6/2006 | Merkys et al. | |
| 2006/0162376 | A1 | 7/2006 | Higashiyama et al. | |
| 2008/0011463 | A1 * | 1/2008 | Timbs | F28D 1/0477 165/151 |
| 2008/0029242 | A1 | 2/2008 | Ben-Salha et al. | |
| 2011/0036553 | A1 * | 2/2011 | Christen | F28D 1/0477 165/185 |
| 2011/0259040 | A1 * | 10/2011 | Cataldo | F16L 11/15 62/498 |
| 2012/0023993 | A1 * | 2/2012 | Palmer | F25D 21/08 62/276 |
| 2012/0266627 | A1 * | 10/2012 | Lee | F25D 17/02 62/452 |

FOREIGN PATENT DOCUMENTS

| | | | |
|---|---|---|---|
| JP | 60261738 | A | 12/1985 |
| KR | 2004081288 | A | 9/2004 |

* cited by examiner

SPECIALTY COOLING FEATURES USING EXTRUDED EVAPORATOR

CROSS-REFERENCE TO RELATED APPLICATION

The present application is a continuation of U.S. patent application Ser. No. 13/833,957 filed Mar. 15, 2013, entitled SPECIALTY COOLING FEATURES USING EXTRUDED EVAPORATOR, now U.S. Pat. No. 9,046,287, which is incorporated herein by reference in its entirety.

FIELD OF THE INVENTION

The present device generally relates to a refrigerator having a co-extruded evaporator, and more specifically, specialty cooling features incorporating and utilizing the co-extruded evaporator.

SUMMARY

In one aspect, an appliance includes a co-extruded evaporator within the appliance and disposed in thermal communication with an interior compartment such that the co-extruded evaporator provides cooling to at least one interior compartment. The co-extruded evaporator has a main channel in fluid communication with a main cooling loop. At least one support channel is in direct thermal communication with the main channel. A wall of the main channel includes at least a portion of a wall of the at least one support channel. A plurality of co-extruded cooling fins are disposed proximate at least one of the main channel and the at least one support channel, where the plurality of cooling fins is typically in direct physical contact with and in thermal communication with at least one of the main channel and the at least one support channel. A coolant fluid is typically disposed in the main channel and the main cooling loop, which typically includes a compressor, a condenser, a pump, at least one expansion device, and the main channel in fluid communication with the coolant fluid. A thermally conductive media that is independent and maintained separate from the coolant fluid disposed in the main channel and the main cooling loop and selectively disposed in each at least one support channel, where the thermally conductive media is in direct contact and in thermal communication with the main channel and in thermal communication with the coolant fluid in the main channel. The thermally conductive media for each at least one support channel is most typically chosen from the group consisting of: (1) a support channel coolant, where the appliance also includes a second cooling loop in fluid communication with the selected at least one support channel, and where the second cooling loop is in thermal communication with at least one cooling module that provides cooling to an interior of the module; (2) a thermal storage material, where the thermal storage material is disposed within a volume defined by an interior surface and first and second ends of the selected at least one support channel, and where the thermal storage media is in thermal communication with the same interior compartment; and (3) a defrost fluid, where the appliance further includes a defrost circuit in fluid communication with the selected at least one support channel and a defrost-fluid pump, and where the defrost circuit is in thermal communication with a heat source.

In another aspect, an appliance includes a co-extruded evaporator disposed in thermal communication with and in thermal communication of an interior compartment of the appliance such that the co-extruded evaporator provides cooling to at least one interior compartment. The co-extruded evaporator has a main channel in fluid communication with a main cooling loop and a support channel in direct thermal communication with the main channel. A wall of the main channel includes at least a portion of a wall of the support channel. A plurality of first co-extruded cooling fins are typically disposed in direct physical contact and in thermal communication with the main channel and a plurality of second co-extruded cooling fins are typically disposed in direct physical contact and in thermal communication with the support channel. A coolant fluid is disposed in the main channel and the main cooling loop. The main cooling loop typically includes at least a compressor, a condenser, at least one expansion device, and the main channel in fluid communication with the coolant fluid. A thermally conductive media that is independent and (physically) maintained separately from the coolant fluid is disposed in the main channel and the main cooling loop. The thermally conductive media is selectively disposed in the support channel, and where the thermally conductive media is in direct contact and in thermal communication with the main channel and in thermal communication with the coolant fluid in the main channel. The thermally conductive media for each at least one support channel is generally chosen from the group consisting of: (1) a support channel coolant, where the appliance further includes a second cooling loop in fluid communication with the selected at least one support channel, and where the second cooling loop is in thermal communication with at least one cooling module that provides cooling to an interior of the module; (2) a thermal storage material, where the thermal storage material is disposed within a volume defined by an interior surface and first and second ends of the selected at least one support channel, and where the thermal storage media is in thermal communication with the same interior compartment; and (3) a defrost fluid, where the appliance further includes a defrost circuit in fluid communication with the selected at least one support channel and the defrost circuit is in fluid communication with a defrost-fluid pump and in thermal communication with a heat source.

Yet another aspect of the present invention is generally directed to a method for advanced cooling of an appliance that includes the steps of providing a co-extruded evaporator that includes a main channel, a support channel in thermal communication with the main channel, where an outer wall of the main channel includes at least a portion of an outer wall of the support channel, and a plurality of co-extruded cooling fins disposed proximate at least one of the main channel and the support channel. The plurality of cooling fins is in direct physical contact and in thermal communication with at least one of the main extruded channel and the support channel. The method also includes the step of disposing the co-extruded evaporator within an appliance having a main loop and at least one compartment. The co-extruded evaporator is proximate to and in thermal communication with the at least one compartment. The main cooling loop is in fluid communication with the main channel of the co-extruded evaporator. The main cooling loop includes at least a compressor, a condenser, at least one expansion device, and the main channel in fluid communication with a coolant fluid disposed in the main channel and the main cooling loop. In addition, the method includes the step of disposing a thermally conductive media within the support channel with the thermally conductive media is in direct contact and in thermal communication with the main channel, and in thermal communication with the coolant fluid in the main channel. The thermally conductive media for each at least one support channel is chosen from the group consisting of: (1) a support channel coolant, where the appliance further includes a second cooling loop in fluid communication with the selected at least one support channel, and where the second cooling loop is in thermal communication with at least one cooling module that provides cooling to an interior of the module; (2) a thermal storage material, where the thermal storage material is disposed within a volume defined by an interior surface and first and second ends of the selected at least one support channel, and where the thermal storage media is in thermal communication with the same interior compartment; and (3) a defrost fluid, where the appliance further includes a defrost circuit in fluid communication with the selected at least one support channel, and where the defrost circuit is in fluid communication with a defrost-fluid pump and in thermal communication with a heat source.

These and other features, advantages, and objects of the present device will be further understood and appreciated by those skilled in the art upon studying the following specification, claims, and appended drawings.

DETAILED DESCRIPTION OF EMBODIMENTS

Figure 1:
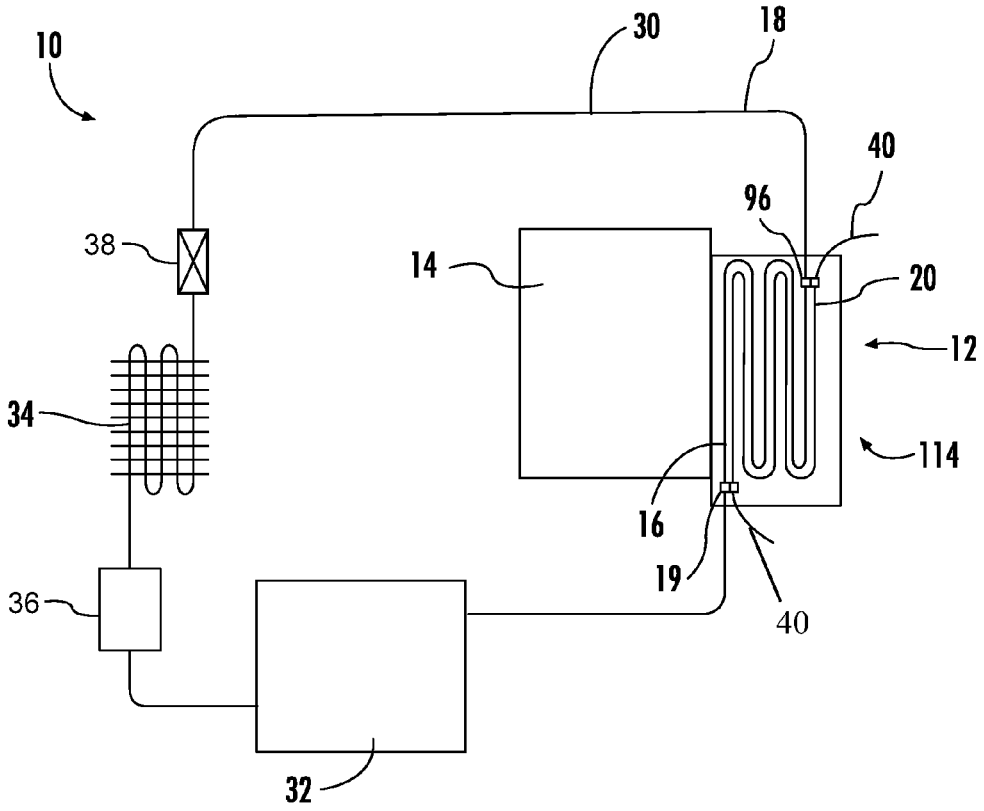
FIG. 1 is a schematic view of a refrigerator according to an aspect of the present disclosure that includes a co-extruded evaporator.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
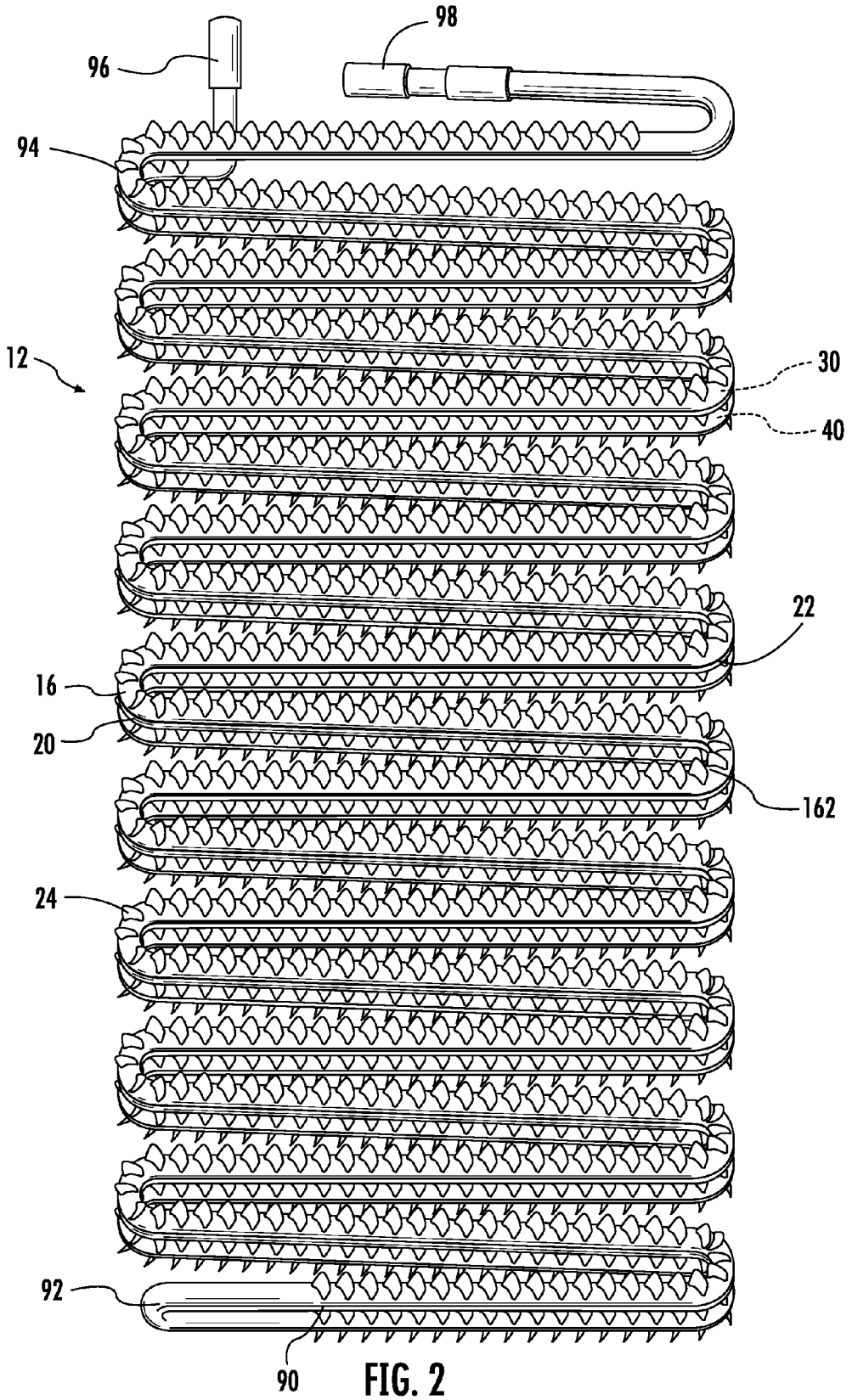
FIG. 2 is a top perspective view of the co-extruded evaporator.

Referring to the embodiment illustrated in FIGS. 1 and 2, reference numeral 10 generally refers to an appliance 10 having a co-extruded evaporator 12 disposed within the appliance 10 and in thermal communication with at least one interior compartment 14 of the appliance 10. The co-extruded evaporator 12 is configured to provide cooling to the at least one interior compartment 14. The co-extruded evaporator 12 includes a main channel 16 that is in fluid communication with a main cooling loop 18 and at least one support channel 20 that is in fluid communication with the main channel 16. A wall of the main channel 16 includes at least a portion of the wall of each at least one support channel 20, such that the main channel 16 and each of the at least one support channels 20 have a common wall 22. The co-extruded evaporator 12 also includes a plurality of co-extruded cooling fins 24 that are disposed proximate the main channel 16 or the at least one support channel 20, or both. The plurality of co-extruded cooling fins 24 is in direct physical contact with, and in thermal communication with, either the main channel 16, the at least one support channel 20, or both.

As shown in FIGS. 1-6, a coolant fluid 30 is disposed within the main channel 16 and the main cooling loop 18. The main cooling loop 18 can include, but is not limited to, a compressor 32, a condenser 34, a pump 36, and at least one expansion device 38. The main channel 16 of the co-extruded evaporator 12 is configured to be in fluid communication with the coolant fluid 30. A thermally conductive media 40 is disposed within the support channel 20. The thermally conductive media 40 is independent and maintained separately from the coolant fluid 30 that is disposed within the main channel 16 and the main cooling loop 18. The thermally conductive media 40 is selectively disposed within each at least one support channel 20. Because of the common wall 22 of the main channel 16 and the at least one support channel 20, the thermally conductive media 40 is in direct contact with and in thermal communication with the main channel 16, and also in thermal communication with the coolant fluid 30 disposed within the main channel 16. The thermally conductive media 40 disposed within each of the at least one support channels 20 can be, but is not limited to, a support channel coolant 50, a thermal storage material 52, or a defrost fluid 54. As will be more fully described below, additional mechanical aspects can be disposed within the appliance 10 depending upon which thermally conductive media 40 is selected for each of the at least one support channel 20.

Referring now to the illustrated embodiment as shown in FIGS. 2-6, the co-extruded evaporator 12 is formed by extruding a single member that includes two main channels 16, two support channels 20, where each of the main channels 16 share a common wall 22 with one support channel 20. A plurality of intermediate cooling fins 72 is coupled with and extends between the two support channels 20 thereby coupling one main and support channel 16, 20 to the other main and the support channel 16, 20. In addition, a plurality of first and second outer cooling fins 74, 76 are disposed to each of the two main channels, and extend away from the plurality of intermediate cooling fins 72.

As shown in FIGS. 1-6, the co-extruded evaporator 12 is configured in an undulating pattern to form the compact evaporator shape that can be disposed within the appliance 10. A first end 90 of the co-extruded evaporator 12 includes a "U" shaped member 92 that couples the two main channels 16, and the two support channels 20. The "U" shaped member 92, similar to the co-extruded evaporator 12, can include a common wall 22 that separates the main and support channels 16, 20. The second end 94 of the co-extruded evaporator 12 includes an input receptacle 96 coupled with one of the main channels 16 and its coupled support channel 20. An output receptacle 98 is coupled to the other main channel 16 and its coupled support channel 20. The input and output receptacles 96, 98 are configured such that the main cooling loop 18 can be coupled to the main channel 16 of the co-extruded evaporator 12 and the support channel 20 can remain independent from the main cooling loop 18 and the main channel 16.

The co-extruded evaporator 12 can also be formed by co-extruding a single main channel 16 and a single support channel 20 that include a common wall 22 shared by the main and support channels 16, 20, and where a plurality of co-extruded cooling fins 24 are disposed on the main and support channels 16, 20. In such an embodiment, a single co-extruded piece can be formed in the shape described above and shown in FIGS. 2-6. Alternatively, in such an embodiment, two co-extruded members can be connected at one end by the "U" shaped member 92, where the other ends of the two co-extruded members can include the input and output receptacles 96, 98, respectively.

As shown in FIGS. 2-6, the plurality of first and second outer cooling fins and the plurality of intermediate cooling fins 72 can each be extruded in single elongated fins. After being extruded, each of the first and second outer cooling fins and the intermediate cooling fin can be manipulated to form the pluralities of first and second outer cooling fins 74, 76 and the plurality of intermediate cooling fins 72 as illustrated in FIGS. 2-6. The manipulation of the pluralities of first, second, and intermediate cooling fins can be accomplished by methods that include, but are not limited to, twisting, slicing, folding, rolling, and other manipulating methods. Manipulating the individual elongated fins serves to increase the surface area of the plurality of co-extruded cooling fins 24 by including the cross-sectional thickness of the plurality of co-extruded cooling fins 24. This also provides additional passageways for air flow between the plurality of co-extruded cooling fins 24 and around the main and support channels 16, 20 to increase the cooling capacity of the co-extruded evaporator 12. In alternate embodiments, each of the pluralities of the first and second outer cooling fins 74, 76 and the plurality of intermediate cooling fins 72 can include bent ridges to further increase the surface area of the co-extruded evaporator 12. It should be understood that the exact configuration of and orientation of each of the pluralities of first 74 and second 76 outer cooling fins, and each of the plurality of intermediate cooling fins 72 can vary within different portions of the co-extruded evaporator 12.

As shown in the embodiment as illustrated in FIGS. 2-6, the co-extruded evaporator 12 can be made of materials, typically, thermally conductive materials, that include, but are not limited to, aluminum, copper and other extrudable metal materials. Similarly, the "U" shaped member 92 can be made of the same material as the co-extruded evaporator 12. In other alternate embodiments, the "U" shaped member 92 can be made of materials that include, but are not limited to, metals, plastics, or other thermally conductive materials. The input and output receptacles 96, 98 can be made of materials that include, but are not limited to, metals, plastics, or other material that is capable of receiving and directing the coolant fluid 30 and the thermally conductive media 40, having various temperature ranges, through the main channel 16 and the support channel 20, respectively, to facilitate the cooling features disposed within the appliance 10.

Figure 7A:
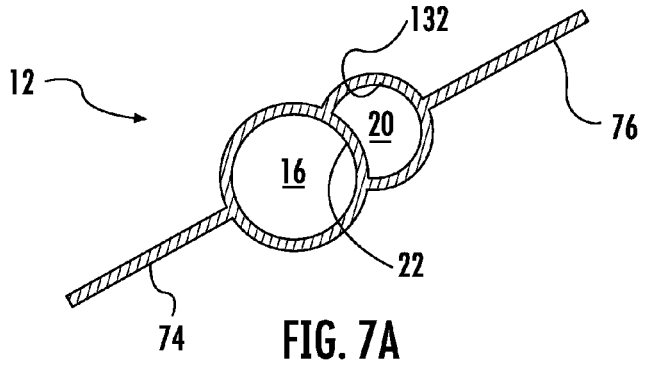
FIG. 7A is a detail section view of a different embodiment of the co-extruded evaporator.
Figure 7B:
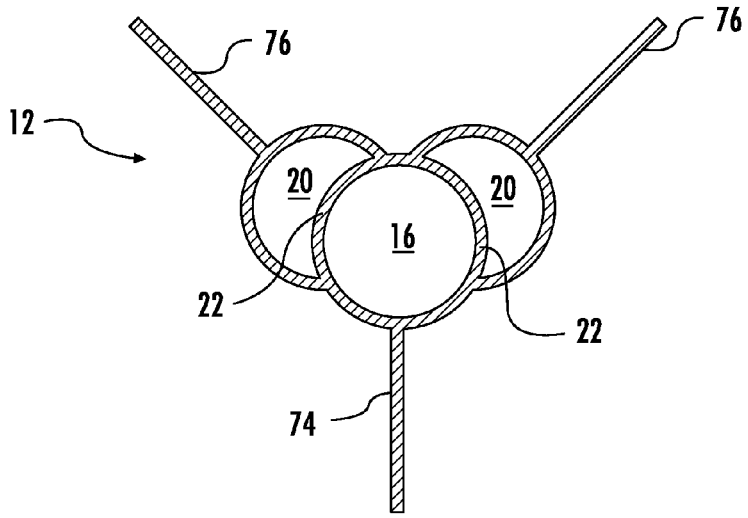
FIG. 7B is a second detail section view of a different embodiment of the co-extruded evaporator.
Figure 7C:
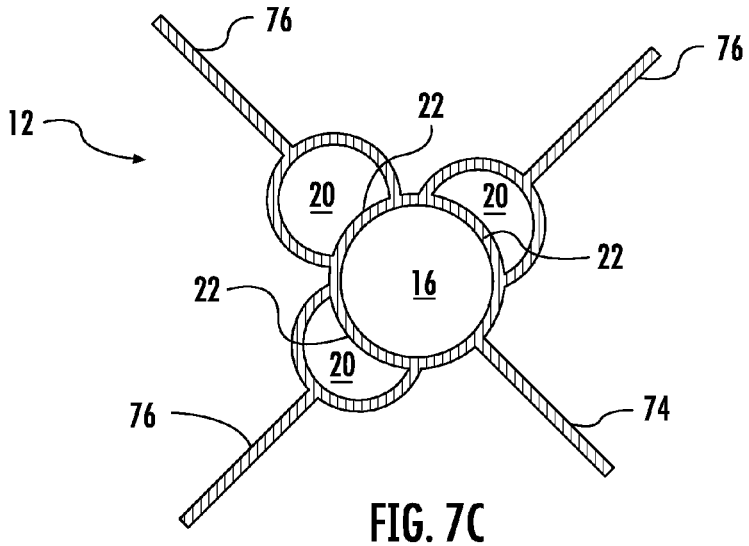
FIG. 7C is a third detail section view of another embodiment of the co-extruded evaporator.

Referring now to FIGS. 7A-7C, in various embodiments, the configuration of the main and the at least one support channel 20 can be extruded into different configurations not limited to but include in these shown so long as at least two channels share at least one common wall. As shown in FIG. 7A, a single main channel 16 and a single support channel 20 can be co-extruded, and include the common wall 22 shared by the main and support channels 20. The first and second outer cooling fins 74, 76 can be co-extruded proximate the main and support channels 16, 20, respectively, and extend outwardly away from the common wall 22.

As shown in the embodiment illustrated in FIG. 7B, the co-extruded evaporator 12 can include the main channel 16 and two support channels 20, where the main channel 16 shares a common wall 22 with each of the two support channels 20. In addition, in such an embodiment, the pluralities of first and second outer cooling fins 74, 76 extend from the main channel 16 and from each of the two support channels 20. In this embodiment, the two support channels 20 can include the same thermally conductive media 40, or can contain two different thermally conductive media 40. Because of the common wall 22 configuration, the thermally conductive media 40 disposed within the two support channels 20 is in fluid communication with the main channel 16 and thermal communication with the coolant fluid 30 disposed within the main channel 16.

Referring now to FIG. 7C, in the illustrated embodiment, the co-extruded evaporator 12 can include a first main channel 60 and three support channels 20, where the common wall 22 is disposed between the main channel 16 and each of the three support channels 20. In this embodiment, a thermally conductive media 40 is disposed within each of the three support channels 20. Various combinations of the thermally conductive media 40, as discussed above, can be disposed in each of the three support channels 20. The thermally conductive media 40 in each of the support channels 20 is separated from the thermally conductive media 40 within the other two support channels 20. The thermally conductive media 40 in each of the support channels 20 is in fluid communication with the main channel 16 at the common walls 22 and is also in thermal communication with the coolant fluid 30 disposed within the main channel 16. In alternate embodiments, the co-extruded evaporator 12 can include additional support channels 20, and additional main channels 16, depending on the various cooling functions that are contained within the appliance 10.

Figure 8:
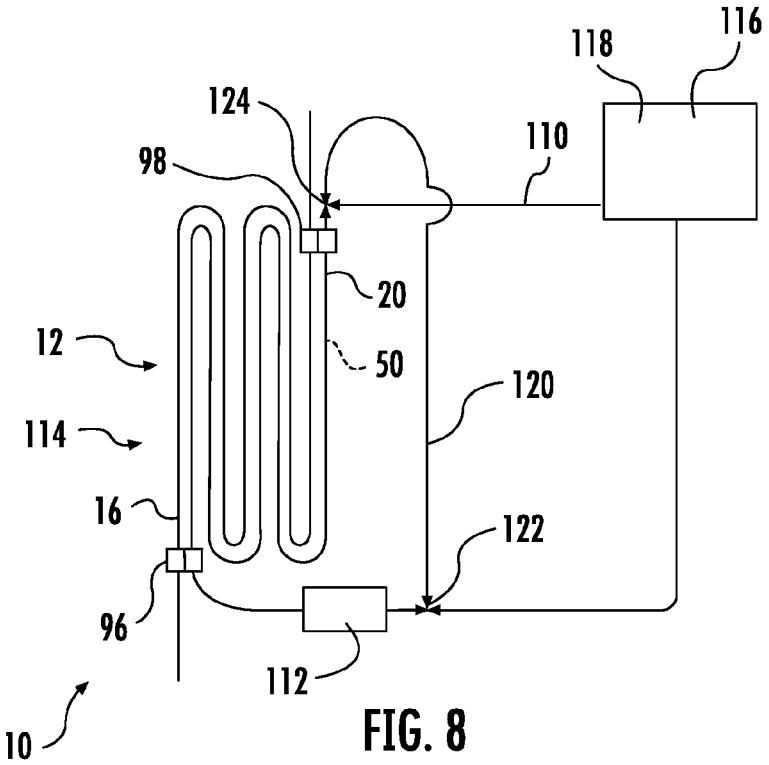
FIG. 8 is a schematic view of a second cooling loop using the co-extruded evaporator of FIG. 2.

Referring now to FIG. 8, in the illustrated embodiment, a support channel coolant 50 is disposed within the support channel 20. In this embodiment, a second cooling loop 110 is coupled with the support channel 20 at the input and output receptacles 96, 98. In this embodiment, the input and output receptacles 96, 98 are configured to receive and direct the support channel 20 coolant through the support channel 20 and the second cooling loop 110 while not allowing the coolant fluid 30 in the main cooling loop 18 to come into contact with the support channel coolant 50 and the second cooling loop 110. The second cooling loop 110 can include a cooling pump 112 that forces the support channel coolant 50 through the support channel 20 and the second cooling loop 110. The cooling pump 112 is typically the only device for moving support channel coolant 50 within the second cooling loop. Typically, the second coolant loop is free of a condenser and a compressor and cooling capacity is received by the support channel coolant solely through thermal conduction across the shared wall 22.

As illustrated in FIGS. 1 and 8, in the illustrated embodiment, the condenser 34 of the main cooling loop 18 decreases the temperature of the coolant fluid 30 within the main cooling loop 18. The pump 36 of the main cooling loop 18 directs the cooled coolant fluid 30 through the input receptacle 96 and into the main channel 16 of the co-extruded evaporator 12. The cooled coolant fluid 30 within the main channel 16 of the co-extruded evaporator 12 provides cooling to the interior compartment 14. In addition, the cooled coolant fluid 30 within the main channel 16 also provides cooling to the support channel coolant 50 disposed within the support channel 20. In this manner, the main channel 16 and the coolant fluid 30 within the main channel 16 functions as a liquid-to-liquid heat exchanger 114 to cool the support channel coolant 50 in the second cooling loop 110, whereby the support channel coolant 50 disposed within the support channel 20 is cooled by the coolant fluid 30 in the main channel 16. The cooling pump 112 of the support channel 20 can direct the cooled support channel coolant 50 through the second cooling loop 110 to a cooling module 116, where the second cooling loop 110 and the support channel coolant 50 provide cooling to an interior 118 of the cooling module 116, resulting in the temperature of the support channel coolant 50 being increased as cooling is transferred from the support channel coolant 50 to the interior 118 of the cooling module 116. The support channel coolant 50 is then directed back to the co-extruded evaporator 12 so that the liquid-to-liquid heat exchanger 114 of the co-extruded evaporator 12 can again decrease the temperature of the support channel coolant 50.

In addition, as illustrated in the embodiment of FIG. 8, a third cooling loop 120 can be coupled with the support channel 20 of the co-extruded evaporator 12 and the second cooling loop 110 such that the support channel 20 is in fluid communication with the secondary and third cooling loops 110, 120. A first valve 122 can be disposed in the second cooling loop 110 proximate the output receptacle 98 such that the first valve 122 is in fluid communication with the support channel 20 of the co-extruded evaporator 12 and the second and third cooling loops 110, 120. The first valve 122 is further configured to selectively control the flow of the support channel coolant 50 from the support channel 20 of the co-extruded evaporator 12 into the second and third cooling loops 110, 120, depending upon the need for cooling in the various cooling functions of the appliance 10. A second valve 124 can be disposed proximate the input receptacle 96 where the second valve 124 is in fluid communication with the support channel 20 of the co-extruded evaporator 12 and the second and third cooling loops 110, 120. The second valve 124 is further configured to selectively control the flow of the support channel coolant 50 from the second and third cooling loops 110, 120 through the input receptacle 96 and into the support channel 20 of the co-extruded evaporator 12. In various embodiments, any number of cooling loops can be included in the appliance depending on the number of channels having at least one shared wall and included in the co-extruded evaporator.

As illustrated in the embodiment of FIG. 8, the cooling pump 112 can be disposed proximate the second valve 124 and the input receptacle 96, such that the cooling pump 112 can work in conjunction with the first and second valves 122, 124 to direct the flow of the support channel coolant 50 through the support channel 20 of the co-extruded evaporator 12 and into either the second or third cooling loop 110, 120, or both. In alternate embodiments, the second and third cooling loop 110, 120 can each include separate and dedicated cooling pumps 112 to provide for the flow of the support channel coolant 50 through the support channel 20 of the co-extruded evaporator 12 and the second and third cooling loops 110, 120.

As further illustrated in the embodiment of FIG. 8, the third cooling loop 120 includes a recycle function, whereby the cooling pump 112 directs the support channel coolant 50 from the output receptacle 98 through the third cooling loop 120 and back to the input receptacle 96, whereby the liquid-to-liquid heat exchanger 114 of the co-extruded evaporator 12 can further decrease the temperature of the support channel coolant 50 for later use in providing cooling to the interior 118 of the cooling module 116 of the second cooling loop 110. In alternate configurations, the third cooling loop 120 can include a separate dedicated cooling module 116, whereby the third cooling loop 120 and the support channel coolant 50 provide cooling to a dedicated cooling module 116 of the third cooling loop 120.

Figure 9:
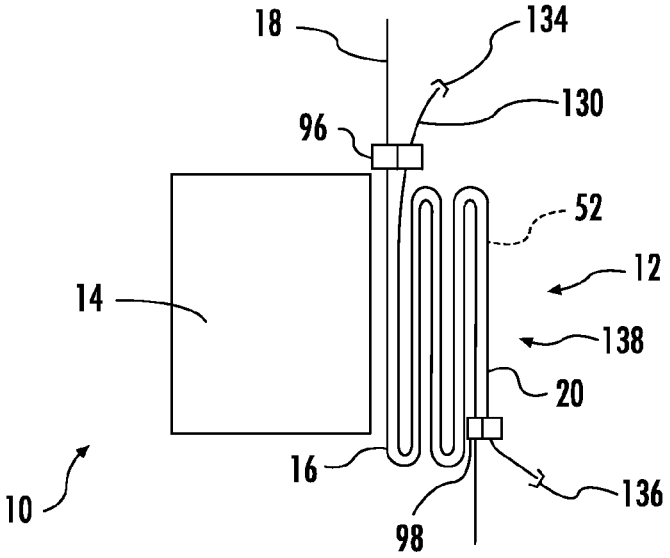
FIG. 9 is a schematic view of a thermal storage device using the co-extruded evaporator of FIG. 2.

Referring now to the embodiment as illustrated in FIG. 9, the second cooling loop 110 can include a thermal storage channel 130 where the thermal storage material 52 is disposed all or at least partially within the thermal storage channel 130. In this embodiment, the thermal storage channel 130 is defined by an inner surface 132 of the support channel 20 of the co-extruded evaporator 12 (shown in FIG. 6). The output receptacle 98 includes a first cap 134 and the input receptacle 96 includes a second cap 136 configured to seal the ends of the support channel 20 of the co-extruded evaporator 12. In this manner, the thermal storage material 52 is contained within the thermal storage channel 130 and is also kept separate from the coolant fluid 30 disposed within the main channel 16 and the main cooling loop 18. The support channel 20 and the main channel 16 are both in thermal communication with the same interior compartment 14.

In this embodiment, as illustrated in FIG. 9, the condensing function of the main channel 16 of the co-extruded evaporator 12 and the coolant fluid 30 disposed within the main channel 16, as discussed above, provides cooling to the thermal storage channel 130 and the thermal storage material 52 contained therein. In this manner, cooling is stored within the thermal storage material 52 and the temperature of the thermal storage material 52 is decreased. The cooling stored within the thermal storage material 52 can be used to provide cooling to the interior compartment 14 disposed proximate the co-extruded evaporator 12. In this manner, the thermal storage material 52 within the thermal storage channel 130 can act as a passive unpowered evaporator 138 for the interior compartment 14.

Figure 10:
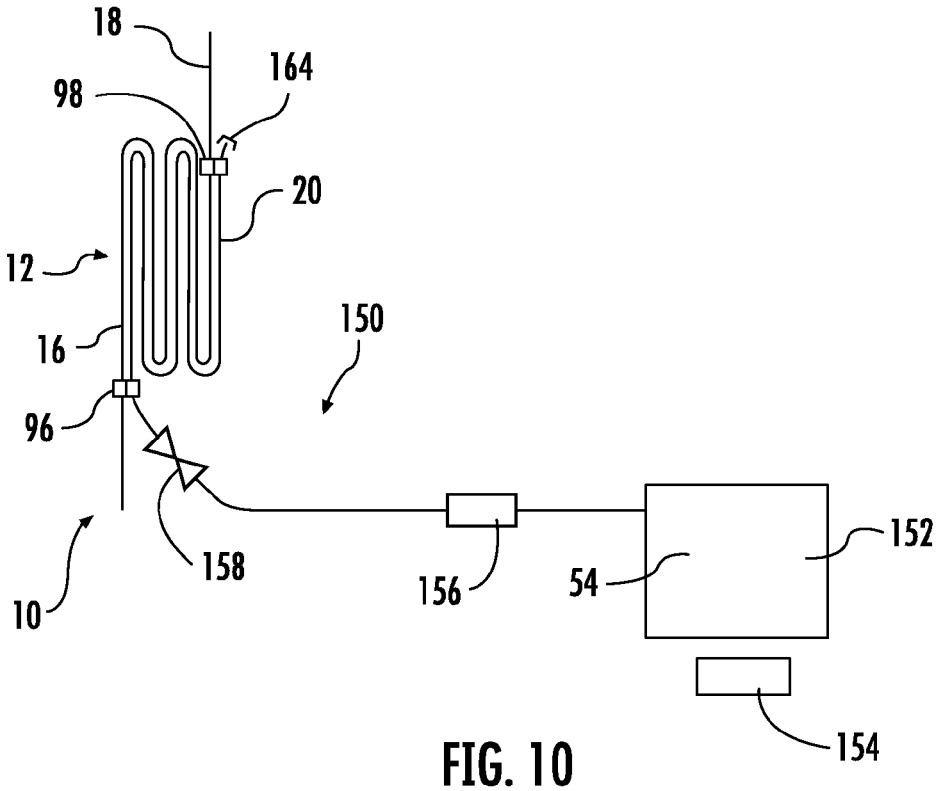
FIG. 10 is a schematic view of a defrost circuit using the co-extruded evaporator of FIG. 2.

As illustrated in the embodiment of FIG. 10, a defrost circuit 150 that includes the defrost fluid 54 can be coupled with the support channel 20 of the co-extruded evaporator 12 at the input and output receptacles 96, 98, such that the defrost circuit 150 is in fluid communication with the support channel 20 of the co-extruded evaporator 12. In this embodiment, the defrost circuit 150 includes a reservoir 152 for storing the defrost fluid 54 and a heat source 154 disposed in thermal communication with the reservoir 152, such that the heat source 154 can increase the temperature of the defrost fluid 54 within the reservoir 152. The defrost circuit 150 can also include a defrost pump 156 for directing the flow of the defrost fluid 54 from the reservoir 152, through the input receptacle 96, and into the support channel 20 of the co-extruded evaporator 12. The defrost pump 156 can work in conjunction with a defrost valve 158 configured to be in fluid communication with the defrost circuit 150 and the support channel 20 of the co-extruded evaporator 12, such that the defrost valve 158 works with the pump 36 to direct the flow of the defrost fluid 54 into the support channel 20 of the co-extruded evaporator 12. The defrost pump 156 is typically the only device for moving defrost fluid 54 within the defrost circuit 150. Typically, the defrost circuit is free of a dedicated heat source and the defrost fluid is warmed by a heat source external to the defrost circuit 150.

Figure 3:
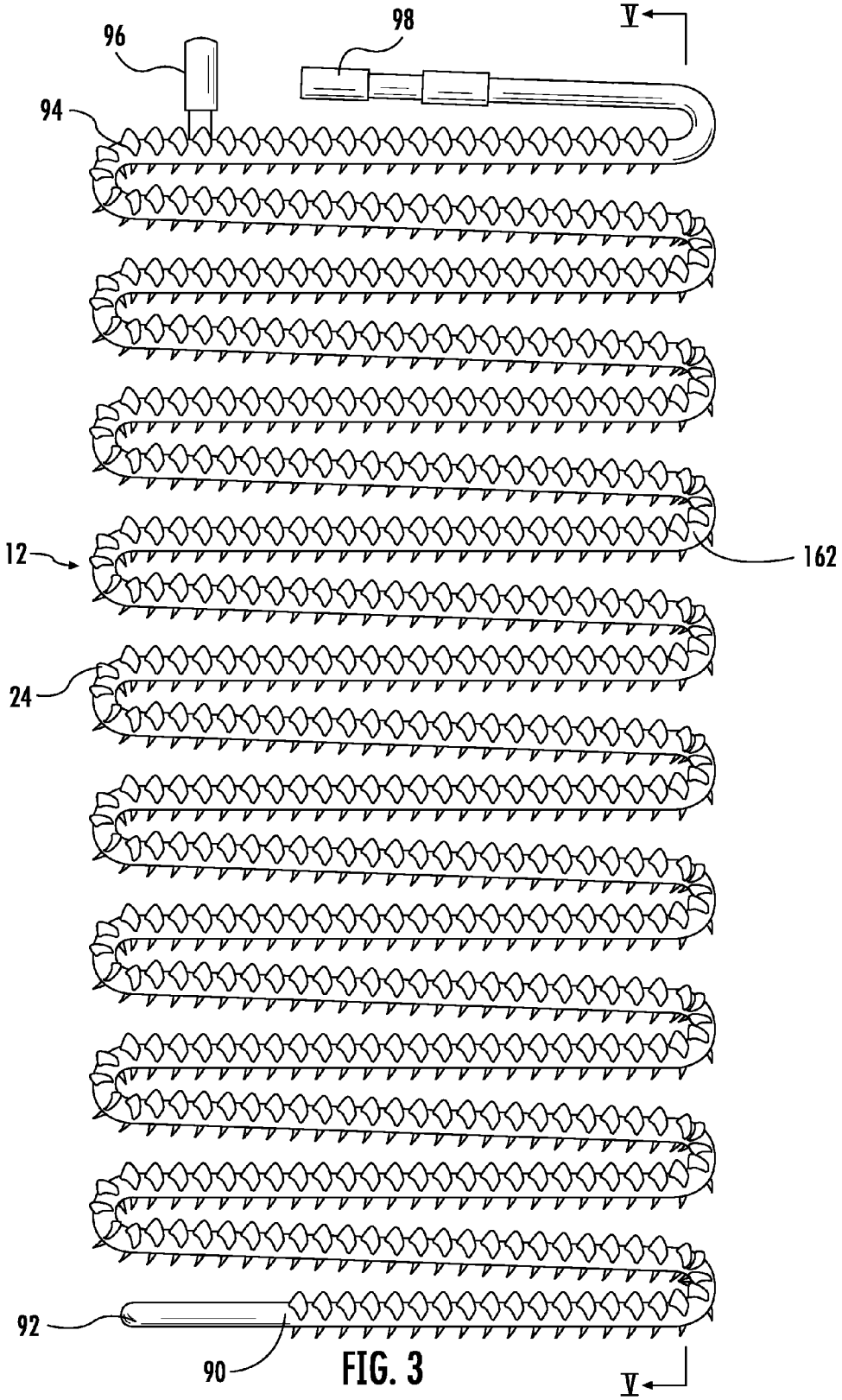
FIG. 3 is a first side view of the co-extruded evaporator of FIG. 2.
Figure 4:
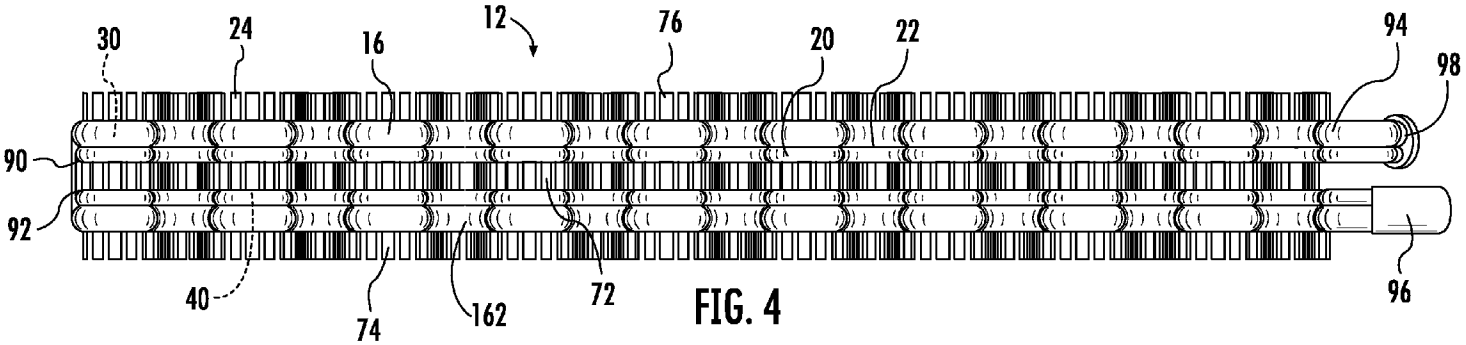
FIG. 4 is a second side elevation view of the co-extruded evaporator of FIG. 2.
Figure 5:
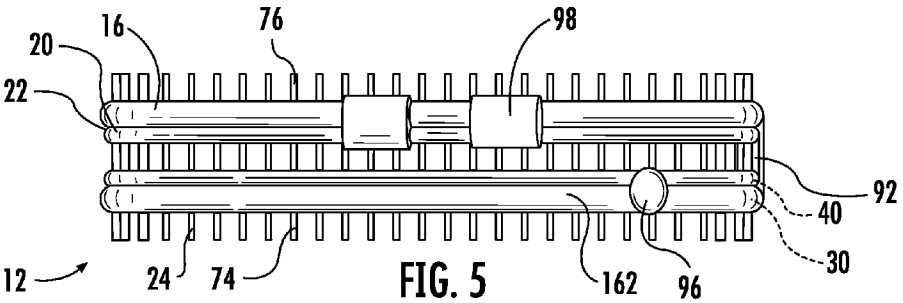
FIG. 5 is a third side elevational view of the co-extruded evaporator of FIG. 2.
Figure 6:
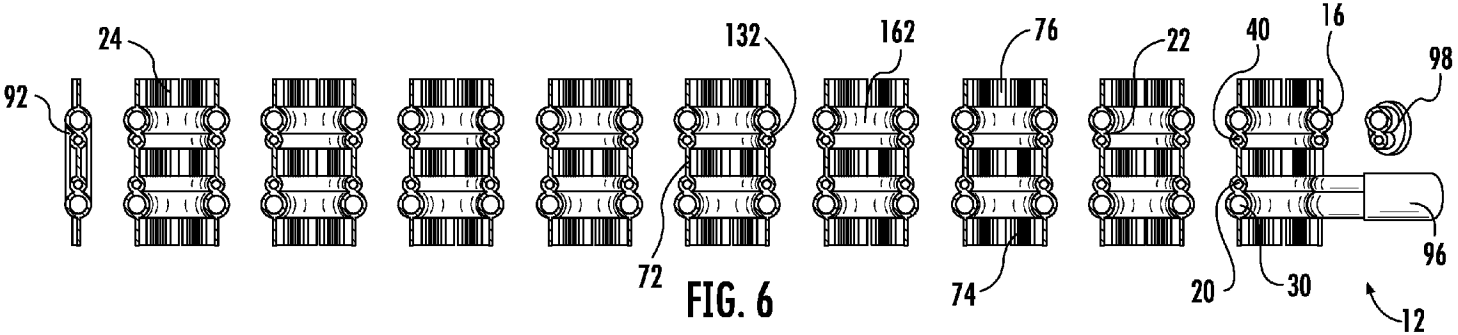
FIG. 6 is a cross-sectional view of the co-extruded evaporator of FIG. 2 taken along line VI-VI in FIG. 3.

As illustrated in the embodiment of FIG. 10, a defrost cycle is initiated to remove frozen water that has accumulated on an outer surface 162 of the co-extruded evaporator 12 (shown in FIG. 3). Once initiated, the defrost cycle can selectively activate the defrost pump 156 to direct the defrost fluid 54 from the reservoir 152 that has been heated by the heat source 154 through the defrost valve 158 and into the support channel 20 of the co-extruded evaporator 12 via the input receptacle 96, then through the output receptacle 98 and back to the reservoir 152 so that the defrost fluid 54 can be reheated and pumped back to the support channel 20 until the defrost circuit is completed. The defrost fluid 54 within the support channel 20 of the co-extruded evaporator 12 increases the temperature of the co-extruded evaporator 12 above the freezing point of water, thereby increasing the temperature of the frozen water disposed on the outer surface 162 of the co-extruded evaporator 12 to a point above the freezing point of water. As a consequence, the frozen water on the outer surface 162 of the co-extruded evaporator 12 changes to liquid water and falls from the outer surface 162 of the co-extruded evaporator 12. At the end of the defrost cycle, the defrost pump 156 is deactivated and the defrost fluid 54 is returned to the reservoir 152 for later use in a subsequent defrost cycle. The defrost circuit 150 can also include a water collector to receive and direct the liquid water that has fallen from the outer surface 162 of the co-extruded evaporator 12.

Figure 11:
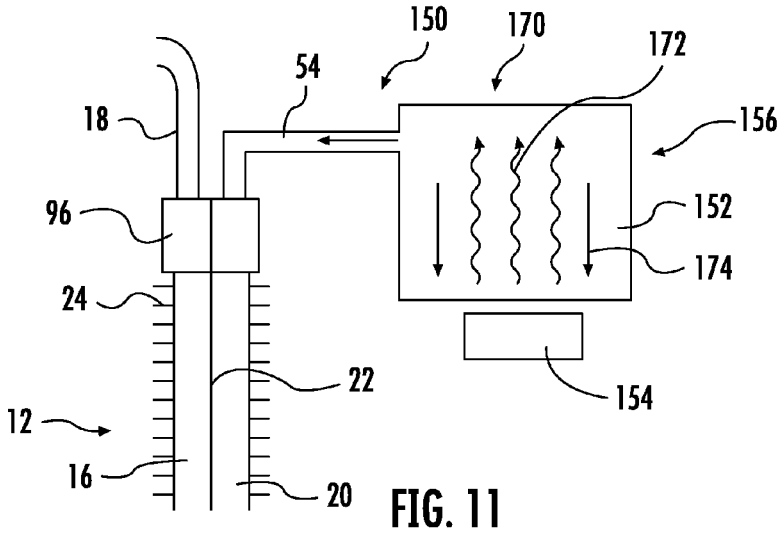
FIG. 11 is an orientation-free schematic view of the defrost circuit using a passive thermosyphon pump.

As illustrated in FIG. 11, which shows no particular orientation, the defrost pump 156 of the defrost circuit 150 can include a passive thermosyphon pump 170 to allow heated defrost fluid 172, which is less dense than cooler defrost fluid 174, to passively flow above the cooler defrost fluid 174 and upward into the defrost circuit 150 and into the support channel 20. In this manner, the passive thermosyphon pump 170 directs the heated defrost fluid 172 into the support channel 20 of the co-extruded evaporator 12. The passive thermosyphon pump 170 also includes the defrost valve 158 for controlling the flow of the defrost fluid 54 into the input receptacle 96, through the support channel 20, out through the output receptacle and back to the passive thermosyphon pump 170, where the defrost fluid can be reheated and recycled through the defrost circuit 150 until the defrost cycle is completed.

In addition, the heat source 154 can include the heat given off by the mechanical aspects of the appliance 10, whereby the heat from the mechanical aspects of the appliance 10 is recycled to heat the defrost fluid 54 within the defrost circuit 150. Further, the heat source 154 of the defrost circuit 150 can be located external to the appliance 10, or the reservoir 152 and the heat source 154 of the defrost circuit 150 can be disposed external to the appliance 10.

Referring again to FIGS. 7A-7C, as discussed above, the co-extruded evaporator 12 can be extruded to include more than one support channel 20. Where more than one support channel 20 is included, more than one of the functions discussed above can be served by the support channels 20 of the co-extruded evaporator 12. By way of example, and not limitation, where two support channels 20 are present, as illustrated in FIG. 7B, the two support channels 20 can serve any two of the secondary cooling, thermal storage, and defrost functions discussed above and as shown in FIGS. 8-10. Alternatively, the two support channels 20 could serve the same or similar functions discussed above.

In addition, as illustrated in FIG. 7C, where three support channels 20 are present, each of the support channels 20 can be dedicated to support any one of the secondary cooling, thermal storage, and defrost functions discussed above and shown in FIGS. 8-10. In the embodiments where multiple support channels 20 are included in the co-extruded evaporator 12, the mechanical aspects described above need to be included in the appliance 10 to serve the multiple functions present in the appliance 10.

Figure 12:
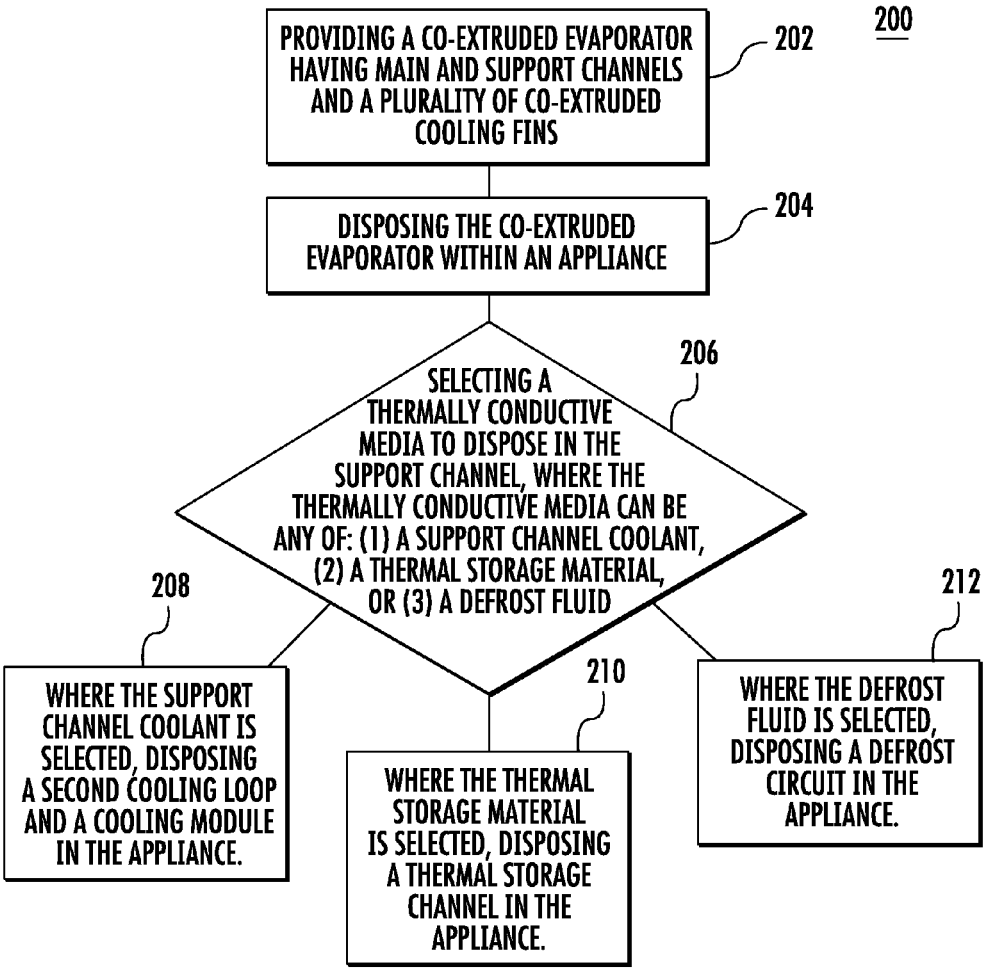
FIG. 12 is a flow diagram of a method for advanced cooling of an appliance according to the present invention.

As illustrated in the embodiment of FIG. 12, another aspect of the appliance 10 includes a method 200 for advanced cooling of an appliance 10 that includes the steps of: (202) providing the co-extruded evaporator 12, as described above, having the main channel 16, the support channel 20 in thermal communication with the main channel 16, the plurality of co-extruded cooling fins 24 that are disposed proximate and in thermal communication with either the main cooling channel, the support channel 20, or both, and where the main channel 16 and support channel 20 share the common wall 22; (204) disposing the co-extruded evaporator 12 within the appliance 10 proximate the main cooling loop 18 and the at least one interior compartment 14, where the main channel 16 of the co-extruded evaporator 12 is in thermal communication with at least one of the at least one interior compartment 14, the main cooling loop 18 and the coolant fluid 30, and where the main cooling loop 18 can include, but is not limited to, a compressor 32, a condenser 34, a pump 36, and at least one expansion device 38; and (206) selectively disposing a thermally conductive media 40 within the support channel 20. The thermally conductive media 40 within the support channel 20 is in direct and thermal communication with the main channel 16 and in thermal communication with the coolant fluid 30 in the main channel 16. As discussed above, and as shown in the embodiment of FIGS. 1 and 8-10, the thermally conductive media 40 disposed within the support channel 20 can include a support channel coolant 50, a thermal storage material 52 and a defrost fluid 54.

According to step 208 of the method 200, and as illustrated in FIG. 8, where the support channel coolant 50 is disposed within the support channel 20, the second cooling loop 110 is disposed in the appliance 10 and is also in fluid communication with the support channel 20. The second cooling loop 110 is in thermal communication with the interior 118 of the cooling module 116, where the second cooling loop 110 and the support channel coolant 50 are configured to provide cooling to the interior 118 of the cooling module 116.

As illustrated in the embodiment of FIG. 8, and as discussed above, the cooling pump 112 is in fluid communication with the second cooling loop 110 and selectively controls the flow of the support channel coolant 50 through the support channel 20 and the second cooling loop 110. The main channel 16 of the co-extruded evaporator 12 and the coolant fluid 30 disposed within the main channel 16 make up the liquid-to-liquid heat exchanger 114 for the second cooling loop 110 to decrease the temperature of the support channel coolant 50 in order to provide cooling to the at least one cooling module 116.

According to step 210 of the method 200, and as illustrated in FIG. 9, where the thermally conductive media 40 disposed within the support channel 20 is the thermal storage material 52, the thermal storage material 52 is disposed within the thermal storage channel defined by the inner surface 132 of the support channel 20 and the first and second caps 134, 136 of the input and output receptacles 96, 98. In this manner, the thermal storage material 52 is in thermal communication with the main channel 16 and the interior compartment 14. In this embodiment, and as discussed above, the main channel 16 of the co-extruded evaporator 12 and the coolant fluid 30 disposed within the main channel 16 provide cooling to, and decrease the temperature of, the thermal storage material 52. The thermal storage material 52, being in thermal communication with the interior compartment 14, can provide passive and unpowered cooling to the interior compartment 14.

According to step 212 of the method 200, and as illustrated in FIG. 10, where the thermally conductive media 40 is the defrost fluid 54, the defrost circuit 150 is disposed in the appliance 10 and is in fluid communication with the support channel 20. The defrost pump is also in fluid communication with the defrost circuit 150 to selectively control the flow of the defrost fluid 54 from the reservoir 152 into the support channel 20 of the co-extruded evaporator 12. The heat source 154 is also disposed proximate the defrost circuit 150 to increase the temperature of the defrost fluid 54.

As shown in the illustrations of FIGS. 7A-10, and as discussed above, the co-extruded evaporator 12 can include multiple support channels 20, each of which can be dedicated to any one of the secondary cooling, thermal storage and defrost functions discussed above.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated. Where two components are disclosed as including a common wall, those components are directly joined such that the common wall is part of each component.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. An evaporator assembly for a refrigerating appliance, the evaporator assembly comprising:

a co-extruded evaporator having a main channel and at least one support channel in direct thermal communication with the main channel, wherein a wall of the main channel comprises at least a portion of a wall of the at least one support channel, and a plurality of co-extruded cooling fins disposed proximate at least one of the main channel and the at least one support channel, wherein the plurality of cooling fins is in direct physical contact with and in thermal communication with at least one of the main channel and the at least one support channel;

a coolant fluid disposed in the main channel;

a thermally conductive media in communication with the at least one support channel, the thermally conductive media being independent and maintained separate from the coolant fluid disposed in the main channel and selectively disposed in each at least one support channel, wherein the thermally conductive media is in direct contact and in thermal communication with the main channel and in thermal communication with the coolant fluid in the main channel.

2. The evaporator assembly of claim 1, wherein the thermally conductive media for each at least one support channel is a support channel coolant.

3. The evaporator assembly of claim 1, wherein the thermally conductive media for each at least one support channel is a thermal storage material, wherein the thermal storage material is disposed within a volume defined by an interior surface and first and second ends of the selected at least one support channel.

4. The evaporator assembly of claim 1, wherein the thermally conductive media for each at least one support channel is a defrost fluid.

5. The evaporator assembly of claim 1, wherein the plurality of co-extruded cooling fins comprises a first plurality of cooling fins disposed in direct contact and in thermal communication with the main channel and a second plurality of cooling fins disposed in direct contact and in thermal communication with the at least one support channel.

6. The evaporator assembly of claim 3, wherein the thermally conductive media within at least one of the at least one support channel is a thermal storage material.

7. The evaporator assembly of claim 1, wherein the at least one support channel includes first and second support channels, and wherein the first support channel includes a defrost fluid and the second support channel contains one of a support channel coolant and a thermal storage material.

8. The evaporator assembly of claim 1, wherein the at least one support channel includes first, second and third support channels, wherein the first support channel includes a defrost fluid, the second support channel includes a support channel coolant and the third support channel includes a thermal storage material.

9. A method for advanced cooling of a refrigerator, utilizing the apparatus of claim 1, the method comprising steps of:

disposing the co-extruded evaporator within an appliance having a main loop and at least one compartment, wherein the co-extruded evaporator is proximate to and in thermal communication with the at least one compartment and the main cooling loop is in communication with the main channel of the co-extruded evaporator, and wherein the main channel is in thermal communication with a coolant fluid disposed in the main cooling loop; and selectively disposing a thermally conductive media within the at least one support channel, wherein the thermally conductive media is in direct contact and in thermal communication with the main channel and in thermal communication with the coolant fluid in the main channel.

10. The method of claim 9, further comprising the steps of:

providing a third cooling loop in fluid communication with the support channel of the co-extruded evaporator; and providing a cooling valve disposed proximate the support channel and in fluid communication with the at least one support channel and the second and third cooling loops, wherein the cooling valve selectively controls flow of coolant from the at least one support channel into the second and third cooling loops.

11. An evaporator assembly comprising:

a co-extruded evaporator disposed in thermal communication with and in thermal communication of an interior compartment of an appliance such that the co-extruded evaporator provides cooling to a portion of the interior compartment, the co-extruded evaporator having a main channel in thermal communication with a main cooling loop and at least one support channel in direct thermal communication with the main channel, wherein a wall of the main channel comprises at least a portion of a wall of each at least one support channel, and a plurality of first co-extruded cooling fins disposed in direct physical contact and in thermal communication with the main channel and a plurality of second co-extruded cooling fins disposed in direct physical contact and in thermal communication with the at least one support channel;

a coolant fluid disposed in the main channel, the coolant fluid in thermal communication with the main cooling loop; and a thermally conductive media selectively disposed within the at least one support channel that is independent and maintained separately from the coolant fluid disposed in the main channel, wherein the thermally conductive media and the coolant fluid are each in direct physical contact with the wall of the main channel.

12. The evaporator assembly of claim 11, wherein the thermally conductive media for each at least one support channel is chosen from a group consisting of:

a. a support channel coolant, wherein the appliance further comprises a second cooling loop in fluid communication with the at least one support channel, and wherein the second cooling loop is in thermal communication with at least one cooling module that provides cooling to an interior of the at least one cooling module;

b. a thermal storage material, wherein the thermal storage material is disposed within a volume defined by an interior surface and first and second ends of the selected at least one support channel, and wherein a thermal storage media is in thermal communication with the same at least one interior compartment; and c. a defrost fluid, wherein the appliance further comprises a defrost circuit in fluid communication with the at least one support channel, and wherein the defrost circuit is in fluid communication with a defrost-fluid pump and in thermal communication with a heat source.

13. The evaporator assembly of claim 12, wherein the thermally conductive media is the support channel coolant, the appliance further comprising:

a liquid-to-liquid heat exchanger, wherein the liquid-to-liquid heat exchanger comprises the main channel and the pluralities of first and second co-extruded cooling fins of the co-extruded evaporator.

14. The evaporator assembly of claim 12, wherein the thermally conductive media is the thermal storage material.

15. The evaporator assembly of claim 13, wherein the appliance comprises a third cooling loop in fluid communication with the at least one support channel, wherein a cooling valve selectively controls flow of the support channel coolant from the at least one support channel to the second and third cooling loops.

16. The evaporator assembly of claim 15, wherein the defrost-fluid pump of the defrost circuit further comprises a passive thermosyphon pump.

17. The evaporator assembly of claim 15, wherein the heat source is located external to the appliance.

18. The evaporator assembly of claim 12, wherein the thermally conductive media is the defrost fluid, the appliance further comprising:

a defrost valve in fluid communication with the defrost circuit and the at least one support channel and disposed proximate a first end of the at least one support channel, wherein the defrost valve is configured to selectively control the flow of the defrost fluid through the at least one support channel;

a defrost cycle in fluid communication with the defrost circuit and configured to selectively control the defrost valve and the defrost-fluid pump to selectively control flow of defrost fluid through the at least one selected support channel, wherein the defrost fluid provides heat to the main channel to melt frozen water present on the main channel.

19. The method of claim 18, wherein the thermally conductive media for each at least one support channel is chosen from a group consisting of:

a. a support channel coolant, wherein the appliance further comprises a second cooling loop in fluid communication with the at least one support channel, and wherein the second cooling loop is in thermal communication with at least one cooling module that provides cooling to an interior of the at least one cooling module;

b. a thermal storage material, wherein the thermal storage material is disposed within a volume defined by an interior surface and first and second ends of the support channel, and wherein the thermal storage material is in thermal communication with the same at least one compartment; and c. a defrost fluid, wherein the appliance further comprises a defrost circuit in fluid communication with the at least one support channel, and wherein the defrost circuit is in fluid communication with a defrost-fluid pump and in thermal communication with a heat source.

20. The method of claim 18, wherein the thermally conductive media is the thermal storage material, wherein the thermal storage material receives and stores cooling from the coolant fluid and transfers the stored cooling to the same at least one compartment.

* * * * *